US010952525B2

(12) United States Patent
Lui et al.

(10) Patent No.: US 10,952,525 B2
(45) Date of Patent: Mar. 23, 2021

(54) SECURED FLEXIBLE CASE FOR POLICE OR MILITARY BATON

(71) Applicant: Armament Systems and Procedures, Inc., Appleton, WI (US)

(72) Inventors: Louisa Lui, Aberdeen (HK); Kevin Parsons, Appleton, WI (US)

(73) Assignee: ARMAMENT SYSTEMS AND PROCEDURES, INC., Appleton, WI (US)

( * ) Notice: Subject to any disclaimer, the term of this patent is extended or adjusted under 35 U.S.C. 154(b) by 31 days.

(21) Appl. No.: 16/251,455

(22) Filed: Jan. 18, 2019

(65) Prior Publication Data

US 2020/0229582 A1 Jul. 23, 2020

(51) Int. Cl.
*A45F 5/02* (2006.01)
*F41C 33/02* (2006.01)

(52) U.S. Cl.
CPC ..... *A45F 5/021* (2013.01); *F41C 33/0218* (2013.01); *A45F 2005/025* (2013.01); *A45F 2200/0566* (2013.01); *A45F 2200/0591* (2013.01)

(58) Field of Classification Search
CPC ..... A45F 5/021; A45F 2005/025; A45F 2200/0591; A45F 2200/0566; F41C 33/0218
USPC ..... 224/197
See application file for complete search history.

(56) References Cited

U.S. PATENT DOCUMENTS 3,501,074 A * 3/1970 Emerick ..... F41C 33/007 224/606
3,637,120 A * 1/1972 Clay ..... A45F 5/02 224/246
4,006,851 A * 2/1977 Kippen ..... F41B 15/02 224/197
4,830,247 A * 5/1989 Banks ..... B25H 3/006 211/70.6
4,955,518 A * 9/1990 Parsons ..... A45F 5/02 224/247
5,152,442 A * 10/1992 Gallagher ..... A45F 5/02 206/3
5,217,151 A * 6/1993 Parsons ..... A45F 5/021 224/236
5,263,619 A * 11/1993 Shoemaker ..... F41B 15/02 224/236

(Continued)

*Primary Examiner* — Nathan J Newhouse
*Assistant Examiner* — Lester L Vanterpool
(74) *Attorney, Agent, or Firm* — Hahn Loeser & Parks LLP

(57) ABSTRACT

A flexible scabbard for securing a baton to equipment worn by a user includes a holster, a cover, and a clip. The holster and cover are made from flexible material. A strip of a first half of a hook and loop fastener wrapping around a top of the front of the holster and a first half of a snap fastener at a center of the front of a holster. The cover has a rear portion extending from the back of the holster to a forward portion having first and second security portions. A second half of the hook and loop fastener extends across the first and second security portions, with a second half of the snap fastener in the middle. When the halves of the snap fastener are engaged and the first and second halves of the hook and loop fastener are engaged, the hook and loop fastener in the security portions is orientated in a shear direction with respect to a release direction of the snap fastener.

21 Claims, 5 Drawing Sheets

(56) References Cited

U.S. PATENT DOCUMENTS 5,351,868 A * 10/1994 Beletsky ..... A45C 11/00 224/245
5,392,975 A * 2/1995 Blankenship, Jr. ..... B05B 9/08 206/317
5,443,192 A * 8/1995 Hodges ..... A45F 5/021 224/148.6
5,449,104 A * 9/1995 Parsons ..... A45F 5/02 224/245
5,503,316 A * 4/1996 Stewart ..... B60R 7/05 224/312
5,533,657 A * 7/1996 Rosen ..... A45F 5/02 224/191
5,586,701 A * 12/1996 Kim ..... F41C 33/0227 224/243
5,711,468 A * 1/1998 Shoemaker ..... A45F 5/02 224/251
5,772,089 A * 6/1998 Parsons ..... A45F 5/02 224/245
5,779,122 A * 7/1998 Martinelli ..... A45C 11/24 224/222
5,813,581 A * 9/1998 Hellweg ..... A45F 5/02 224/251
5,839,630 A * 11/1998 Dunstan ..... A45F 5/02 224/197
5,964,386 A * 10/1999 Cote ..... A45F 5/02 224/236
6,059,157 A * 5/2000 Parsons ..... A45F 5/02 224/245
6,145,654 A * 11/2000 Loghman ..... B65D 83/384 206/37
6,182,878 B1 * 2/2001 Racca ..... A45C 15/00 224/236
D450,451 S * 11/2001 Starrett ..... D3/229
6,497,349 B1 * 12/2002 Ramirez ..... A45F 5/00 224/200
6,641,015 B2 * 11/2003 Huggins, Jr. ..... A45C 11/24 224/236
6,889,878 B2 * 5/2005 Parsons ..... A45F 5/02 224/197
7,210,604 B2 * 5/2007 Kostal ..... A45F 5/02 224/200
7,389,899 B2 * 6/2008 Johnson ..... A45F 5/021 224/675
8,074,850 B2 * 12/2011 Soderquist ..... F41C 33/0227 224/243
8,308,033 B2 * 11/2012 Case ..... A45F 5/02 224/197
8,631,980 B2 * 1/2014 Youssefi-Shams ..... A45F 5/021 224/197
8,720,755 B2 * 5/2014 Gregory ..... F41C 33/0263 224/244
D754,277 S * 4/2016 Wisecup ..... D22/117
9,476,670 B2 10/2016 Parsons et al.
9,615,614 B2 * 4/2017 Lamper ..... A41D 27/201
D824,163 S * 7/2018 Cheng ..... D3/229
10,080,423 B1 * 9/2018 Bandlow ..... F41C 33/0227
D852,494 S * 7/2019 Gregg-Baker ..... D3/229
2001/0022161 A1 * 9/2001 Macedo ..... A01K 27/004 119/796
2003/0141329 A1 * 7/2003 Huang ..... A45F 5/02 224/197
2007/0068982 A1 * 3/2007 Grundy ..... A45F 5/02 224/236
2007/0235481 A1 * 10/2007 Parsons ..... A45F 5/02 224/197
2007/0278266 A1 * 12/2007 Parsons ..... A45F 5/02 224/197
2012/0223110 A1 * 9/2012 Gregory ..... F41C 33/0209 224/193
2013/0126566 A1 * 5/2013 Seuk ..... A45F 5/00 224/223
2015/0122863 A1 5/2015 Parsons et al.
2015/0237998 A1 * 8/2015 Stevens, IV ..... F41C 33/0209 224/660

* cited by examiner

SECURED FLEXIBLE CASE FOR POLICE OR MILITARY BATON

BACKGROUND

Police and security personnel are often required to carry weapons of intermediate force such as nightsticks or batons. Batons are available in a variety of sizes, often times comprising three telescoping sections. In the retracted position, an expandable baton is only approximately one-third of its extended length.

In general, a baton scabbard may be attached to a waist belt or utility vest of the officer to enable the efficient transport and deployment of a baton. The scabbard should allow for a wide range of deployment or withdrawal directions that may be required when in pursuit or subduing a subject. However, the scabbard should also secure the baton to the officer during the officer's daily activities, such as when the officer is pursuing a subject and may be required to run, jump, climb over walls or fences or move quickly up or down stairs.

Scabbards may be made of rigid plastic, providing various means, such as a spring or a compression fit, for securely engaging a baton in the scabbard. However, flexible fabric scabbards may be desired for comfort or other reasons. Accordingly, there is a need for a flexible scabbard that secures a baton against loss while enabling quick deployment when needed.

SUMMARY

A flexible scabbard for securing a baton to equipment worn by a user includes a holster, a cover, and a clip. The holster has a flat back and a curved front. The holster further has a strip of a first half of a hook and loop fastener wrapping around a top of the curved front of the holster and a first half of a snap fastener at a center of the top of the front of a holster. The cover is fabricated from flexible material and has a rear portion extending from the back of the holster to a forward portion having a distal end, the distal end including first and second security portions opposite each other extending a width of the distal end. A second of the half hook and loop fastener extends across the width of the distal end, including the first and second security portions, and a second half of the snap fastener is disposed between the first and second security portions. The clip is rotatably attached to the back of the scabbard. The fasteners are arranged such that when the first and second halves of the snap fastener are engaged and the first and second halves of the hook and loop fastener are engaged, the hook and loop fastener in the first and second security portions is orientated in a shear direction with respect to a release direction of the snap fastener.

The scabbard may further include a baton cradle disposed on the rear portion of the cover and aligned with the holster. The baton cradle may be made from flexible foam.

In one example, the holster and cover are fabricated from a single piece of flexible material, such as fabric. The single piece of flexible material may also comprise a laminate of fabric and closed cell foam which is molded to shape. For example, the front of the holster may be molded into a U-shape and dimensioned to accept a baton.

A resilient strip may be attached to the flexible material from the rear portion of the cover to the forward portion of the cover to support the cover in an open position to facilitate drawing a baton from the holster.

The width of the distal end of the cover including the security portions is preferably wider than a width of the rear portion of the cover. For example, the first and second security portions extend to at least 90° on either side of the snap fastener when engaged on the holster.

The clip may be rotatably attached to the back of the scabbard by a mounting plate that is attached to the back of the holster and the rear portion of the cover. The clip may further comprise a mounting plate having a plurality of horizontal slots and an adjustable spacer insertable in each of the plurality of horizontal slots, wherein at least one of the slots is located such that when the adjustable spacer is inserted therein a position of the scabbard is raised relative to the equipment worn by the user.

DETAILED DESCRIPTION

Figure 5:
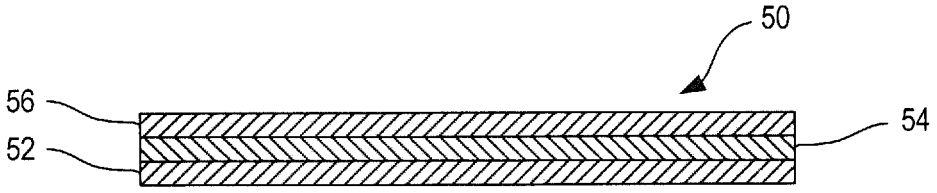
FIG. 5 is an illustration of an exemplary layup of a laminated fabric which may be used in implementing the present invention.
Figure 6:
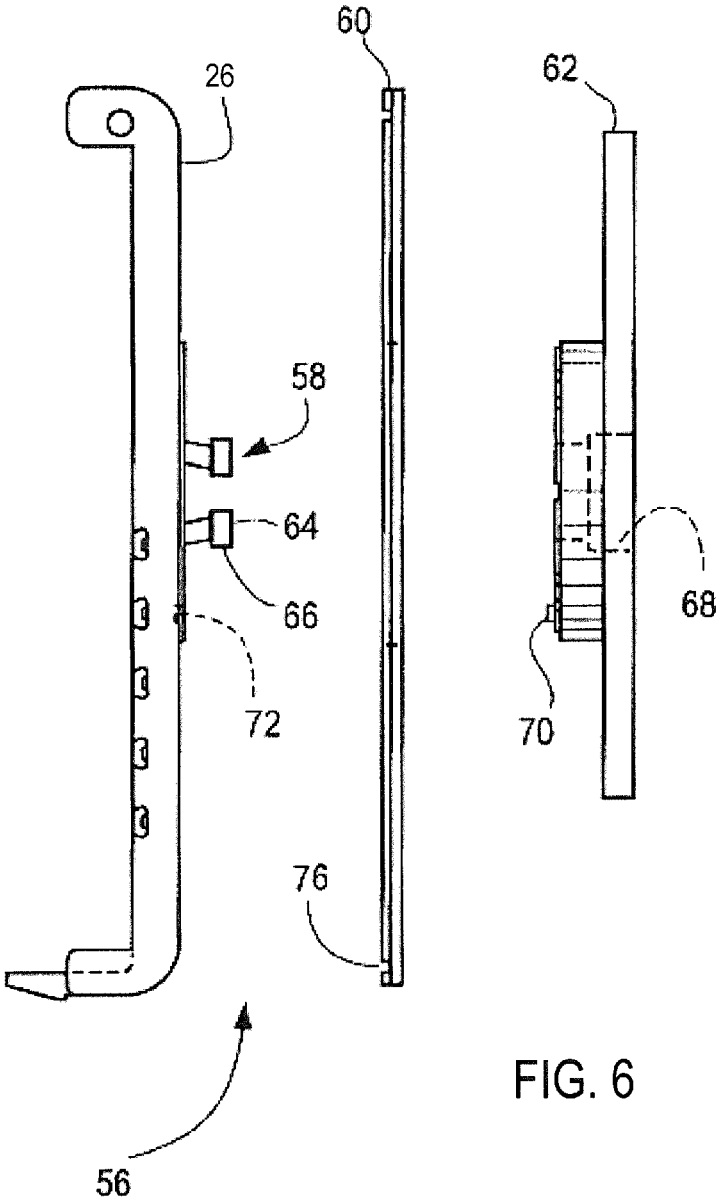
FIG. 6 is an exploded view of components for attaching a pivoting joint of the clip to a scabbard according to the present invention.

A scabbard 10 may comprise a holster 12, a holster cover 14, and a clip 36. The holster 12 and holster cover 14 may be formed separately and joined together or may be formed from a continuous piece of flexible material. The flexible material may comprise ballistic weave nylon or polyester fabric. In another example, the flexible material may comprise ballistic weave fabric laminated with a closed cell foam (such as ethylene vinyl acetate, or "EVA"), and the composite fabric is molded and/or formed by heating and compressing the EVA to a desired shape. In addition to providing a molded shape, a laminated composite fabric may also improve the stiffness of flat regions. Referring to FIG. 5, the composite fabric 50 may comprise three layers; a first layer of fabric 52, a layer of EVA closed cell foam 54, and a second layer of fabric 56.

In the example of FIGS. 1-4, a single piece of flexible material, such as the composite fabric 50 described above, may be molded to shape, folded over at one end and sewn to itself to form the holster 12, and the flexible material may extend to provide the cover 14. The holster 12 may have a front and a back. The back of the holster 12 may be flat to allow for attachment of a clip 36. The front of the holster 12 may be curved to conform to the shape of a baton 80. For example, the front of the holster 12 may be generally U-shaped and dimensioned to accept a baton. The U-shape may be achieved by molding as described above. The cover 14 may comprise a rear portion extending from the back of the holster 12 to a forward portion of the cover having a distal end 16, with sufficient length to secure a baton within the holster when the distal end is secured to the holster.

The flexible material may further comprise a resilient strip 46 sewn or otherwise attached to the flexible material in a lengthwise direction of the fabric from the rear portion of the cover to the forward portion of the cover. The resilient strip resists being curved and functions as a spring to support the cover in an open position. This keeps the cover out of the way and improves access while drawing a baton from the holster. The flexible material may also be molded to a shape which supports an unfastened cover open. Flexible materials other than fabric may also be suitable for the scabbard 10. In such examples, different means of joining the materials, such as adhesive or ultrasonic welding may be employed.

The distal end of the cover 14 includes one half of a snap fastener 18*a* and a strip of hook and loop fastener 20*a*. The top of the holster 12 has a corresponding other half of the snap fastener 18*b* and strip of hook and loop fastener 20*b*. Hook and loop fasteners are available, for example, under the brand name Velcro.

Preferably, the holster 12 is dimensioned such that when carrying a baton 80, enough of the handle of the baton 80 is exposed to allow a user to obtain a full grip (e.g., about four inches). However, a flexible cover extending up from the back of the holster 12 four inches over the handle of the baton 80, and then back down four inches to the front of the holster 12, creates a risk that the cover will slip aside from the baton 80. To reduce this risk, a baton cradle 22 is provided on the rear portion of the cover aligned with and above the holster 12, and near the end where a baton handle would be. The baton cradle 22 may be made of foam, rubber, or other flexible material. The baton cradle 22 may be generally U-shaped to match the outer circumference of the handle of the baton 80. The baton cradle 22 helps hold the cover in fixed relationship with respect to a baton 80 when the cover is fastened over the baton 80.

On the back side 24 of the scabbard 10, a clip 36 is provided. The clip may be as described in U.S. Pat. No. 9,476,670, which is incorporated by reference. Briefly, the clip 36 generally includes an elongated mounting or mounting plate 26 and cover plate 28. The mounting plate 26 and elongated cover plate 28 are joined at a first longitudinal end by a hinge 38. A resilient lock 40 secures the second ends of the mounting and cover plates together around equipment worn by a user (e.g., a belt, a MOLLE vest, etc.).

Also included on the mounting plate 26 are a number of slots 32 extending across the mounting plate 26, perpendicular to the longitudinal axis. Installed within one of the slots 32 is an adjustable spacer 30. The slots 32 on the lower portion of the mounting plate 26 allow the belt clip to be adjusted to a plurality of different belt or webbing widths as previously known. Slot 32*a* on the upper portion of the mounting plate 26 serves a different purpose. Inserting the adjustable spacer 30 into slot 32*a* raises the position of the scabbard relative to a belt to which it is clipped. Changing the position of the scabbard permits a user to improve access to draw the baton for use and/or improve comfort in wearing the scabbard.

To aid in retention of the adjustable spacer 30 the width of the cross section at the root of the slot 32 is greater than the width at the entry of the slot 32. A corresponding slot engaging portion is provided on the adjustable spacer 30.

In general, the adjustable spacer 30 is inserted into any one of the slots 32 from an edge of the clip transverse to the longitude of the mounting plate 26. In this regard, a user may grasp the adjustable spacer 30 from a proximal end and insert the distal end into one of the slots 32. Since the cross section of the slot engaging portion of the adjustable spacer 30 is somewhat smaller than the cross section of the slot 32, it could be expected that the adjustable spacer 30 could fall out of the mounting plate 26 and be easily lost. However, the mounting plate 26 offers a number of features that prevent this possibility from happening.

Figure 1:
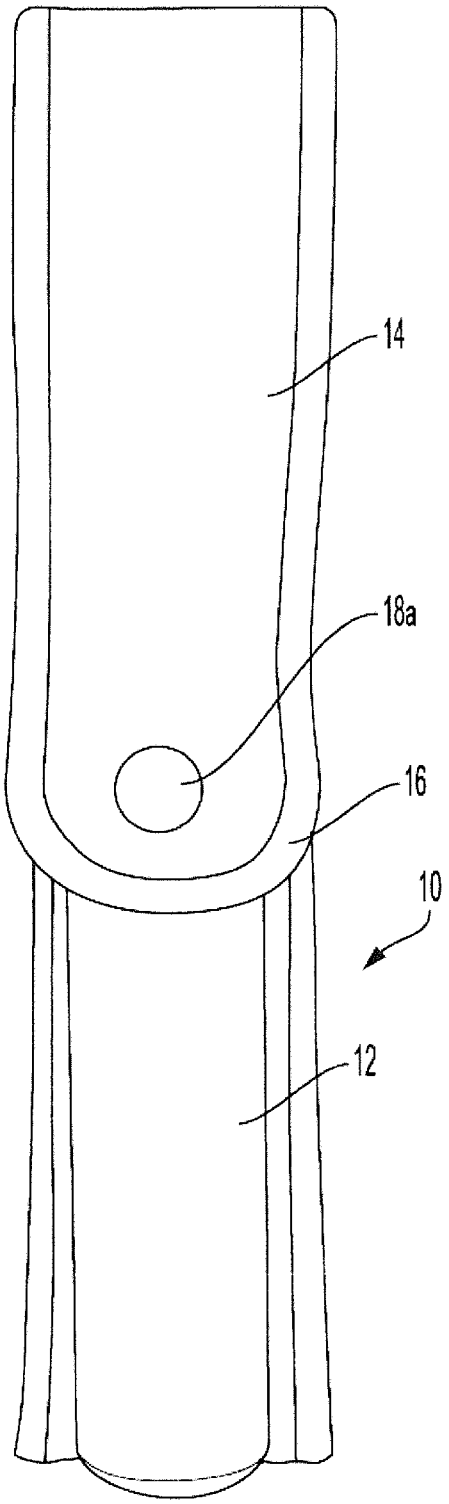
FIG. 1 is a front view of a scabbard according to the present invention with the cover closed.
Figure 2:
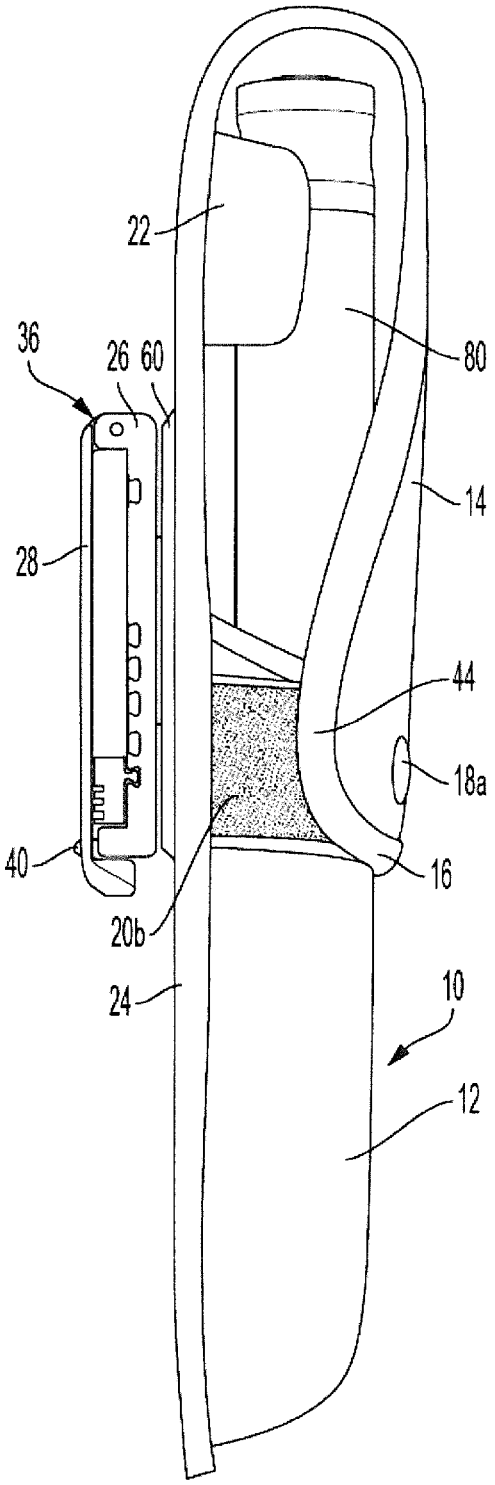
FIG. 2 is a side view of a scabbard according to the present invention with the cover closed over a baton.
Figure 3:
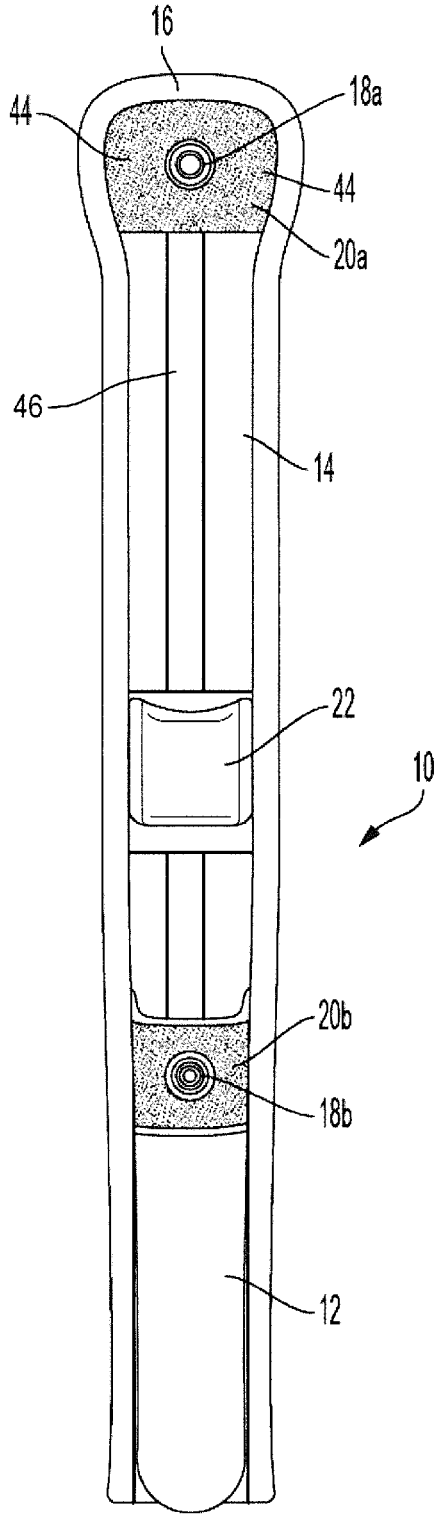
FIG. 3 is a front view of a scabbard according to the present invention with the cover open.
Figure 4:
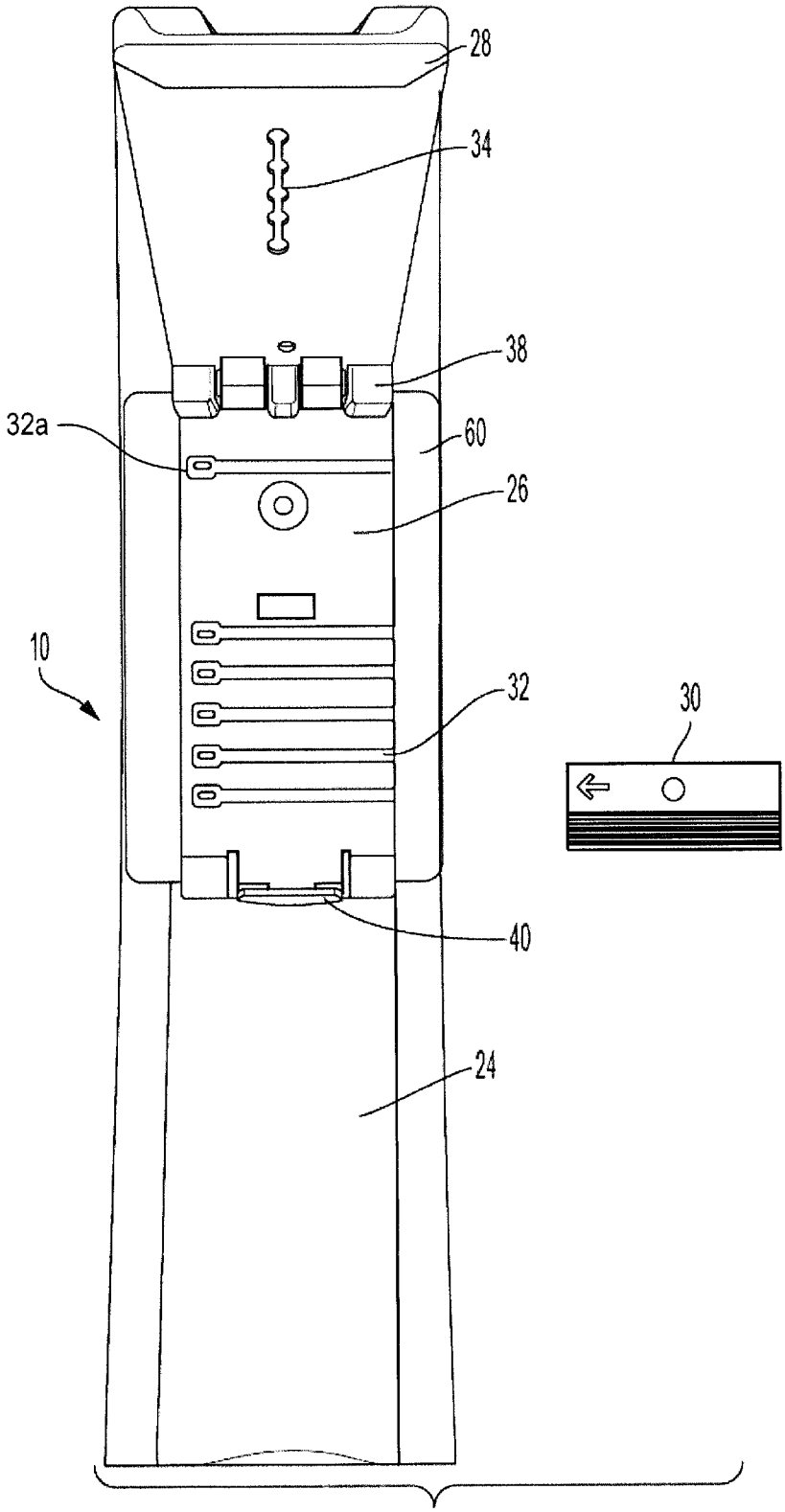
FIG. 4 is a rear view of a scabbard according to the present invention with the clip opened.

For example, the slots 32 may be closed on one end. For example, FIG. 4 shows that the slots 32 are closed on the left side. Another feature that prevents the adjustable spacer 30 from being lost may comprise a peg 52 extending from the top of the adjustable spacer 30. The peg engages one of a plurality of apertures 54 in the inside surface of the cover plate 28. In this regard, each of the apertures is centered over a corresponding slot 32. As such, when the adjustable spacer 30 is inserted into a slot 32 and the cover plate 28 is folded over the adjustable spacer 30, the peg engages the aperture over that slot 32 thereby locking the adjustable spacer 30 into that slot 32 at least until the clip is again opened.

FIG. 5 shows an exploded view of components for attaching a pivoting joint of the clip 36 to the scabbard 10. The pivoting joint may include a hub 58, an attachment plate 60 and a retaining plate 62. In this case, a post 64 with an outer lip 66 extends through the attachment plate 60 and aperture 68 in the retaining plate. The lip engages a distal side of the retaining plate thereby attaching the retaining plate and attachment plate 60 to the mounting plate 26. A post 70 in the retaining plate engages a slot 72 in the mounting plate 26 to allow a rotation of only 90 degrees from either side of the center position shown in FIGS. 2 and 4.

The attachment plate 60 may be constructed from any of a number of rigid, semi-flexible or flexible materials, for example, plastic or synthetic rubber. In general, the attachment plate 60 has a greater length and width than the retaining plate 62. This allows an outer periphery of the attachment plate to be joined to the scabbard 10 via an appropriate connection material (e.g., thread). In this regard, a channel 76 may be routed along the edge of the attachment plate and through which the attachment plate may be sewn to the scabbard 10. In the example illustrated in FIGS. 2 and 4 the attachment plate 60 is plastic and is sewn to the top of the back of the holster 12 and extends upwards on the back of the rear portion of the cover towards the baton cradle 22. This stiffens the rear portion of the cover and keeps the baton cradle 22 in place.

The snap fastener 18*b* is located at a center of the front of the holster 12. The hook and loop fastener 20*b* on the holster 12 wraps all the way around the front of the holster 12. The distal end 16 of the cover 14 is widened relative to the rest of the cover 14 with security portions 44 to provide additional length to the hook and loop fastener 20*a*. To secure a baton 80 in the scabbard 10, a user inserts the baton 80 into the holster 12 and closes the cover over the baton 80. The user snaps the snap fastener halves 18*a*, 18*b* together to provide a first measure of security. The user then presses the hook and loop fastener on the cover 14 to engage the hook and loop fastener on the holster 12, wrapping the security portions 44 of the distal end 16 around the holster 12 over an arc of 120 degrees to 180 degrees or more.

Hook and loop fasteners provide greater shear strength (strength in a direction parallel to the plane of the joined surfaces) than peel strength (strength in a direction normal to the plane of the joined surfaces). In the present example, the security portions of the distal end of the cover extend the hook and loop fasteners around the holster 12 to about 90 degrees or more on either side of the front of the holster 12. This is not done for the purpose of simply increasing an amount of hook and loop fastener being engaged. Instead, by wrapping around a generally U-shaped or other curved holster 12, the extra length orients the hook and loop fastener halves 20*a*, 20*b* of the security portions 44 at the sides of the front of the holster 12 and in the shear direction relative to the release direction of the snap fastener halves

18*a*, 18*b*. This shear orientation of the hook and loop fastener halves 20*a*, 20*b* in the security portions 44 relative to the snap fastener halves 18*a*, 18*b* renders the cover 14 much more resistant to being opened by simply lifting the distal end 16 of the cover 14 at the snap fastener.

However, this extra security does not impede a user from quickly drawing the baton 80. For example, if the user wears the scabbard 10 on his or her non-dominant hand side, the user may simply peel the hook and loop fastener from the side with a single sweeping motion of the user's non-dominant hand, exposing the baton 80. The user may then perform a cross draw of the baton 80 with the user's dominant hand.

The descriptions and illustrations provided herein are meant to be illustrative and not limiting. It will be understood that the flexible cases of the present invention can be modified without departing from the teachings of the invention. Accordingly, the scope of the invention is only to be limited as necessitated by the accompanying claims.

What is claimed is:

1. A scabbard for securing a baton to equipment worn by a user, the scabbard comprising:

a holster having a flat back and a curved front, the holster further comprising a strip of a first half of a hook and loop fastener wrapping around a top of the curved front of the holster and a first half of a snap fastener at a center of the top of the front of the holster;

a cover fabricated from flexible material having a rear portion extending from the back of the holster, and further extending to a forward portion having a distal end, the distal end including first and second security portions opposite each other extending across a width of the distal end, a second half of the hook and loop fastener extending across the width of the distal end including the first and second security portions, the hook and loop fastener having a shear direction, and a second half of the snap fastener disposed between the first and second security portions, the snap fastener having a release direction extending away from the center of the top of the holster;

a clip attached to the back of the scabbard;

wherein when the first and second halves of the snap fastener are engaged and the first and second halves of the hook and loop fastener are engaged, the hook and loop fastener in the first and second security portions is orientated with its shear direction aligned with the release direction of the snap fastener.

2. The scabbard of claim 1, further comprising a baton cradle disposed on the rear portion of the cover and aligned with and above the holster.

3. The scabbard of claim 2, wherein the baton cradle is flexible foam molded in a shape to match an outer circumference of a handle of a baton.

4. The scabbard of claim 1, wherein the width of the distal end including the security portions exceeds a width of the rear portion of the cover.

5. The scabbard of claim 1, wherein the front of the holster is U-shaped.

6. The scabbard of claim 1, wherein the first and second security portions extend to at least 90° on either side of the snap fastener when engaged on the holster.

7. The scabbard of claim 1, wherein the holster is fabricated from a flexible material.

8. The scabbard of claim 1, wherein the holster and cover are fabricated from a single piece of flexible material.

9. The scabbard of claim 8, further comprising a resilient strip sewn to the flexible material from the rear portion of the cover to the forward portion of the cover to support the cover in an open position.

10. The scabbard of claim 8, wherein the flexible material further comprises a fabric and foam laminate.

11. The scabbard of claim 8, wherein the flexible material further comprises a fabric and closed cell foam laminate that has been molded to a desired shape.

12. The scabbard of claim 8, wherein the flexible material further comprises a ballistic weave fabric and closed cell foam laminate which is molded to form the curved front of the holster and flat back of the holster, and wherein the flexible material is folded over and the curved front is sewn to the flat back to form the holster.

13. The scabbard of claim 1, wherein the clip is attached to the back of the scabbard by retaining plate that is disposed between the back of the holster and the rear portion of the cover and an attachment plate.

14. The scabbard of claim 13, wherein the attachment plate is sewn to the back of the holster and rear portion of the cover.

15. A scabbard for securing a baton to equipment worn by a user, the scabbard comprising:

a holster fabricated from flexible material having a flat back and a curved front, the holster further comprising a strip of a first half of a hook and loop fastener wrapping around a top of the curved front of the holster and a first half of a snap fastener at a center of the top of the front of the holster;

a cover fabricated from flexible material having a rear portion extending from the back of the holster, and further extending to a forward portion having a distal end, the distal end including first and second security portions opposite each other extending across a width of the distal end exceeding a width of the rear portion of the cover, a second half of the hook and loop fastener extending across the width of the distal end including the first and second security portions, the hook and loop fastener having a shear direction, and a second half of the snap fastener is disposed between the first and second security portions, the snap fastener having a release direction extending away from the center of the top of the holster;

a baton cradle disposed on the rear portion of the cover and aligned with and above the holster; and a clip attached to the back of the scabbard;

wherein when the first and second halves of the snap fastener are engaged and the first and second halves of the hook and loop fastener are engaged, the hook and loop fastener in the first and second security portions is orientated with its shear direction aligned with the release direction of the snap fastener.

16. The scabbard of claim 15, wherein the baton cradle is flexible foam molded in a shape to match an outer circumference of a handle of a baton.

17. The scabbard of claim 15, wherein the first and second security portions extend to at least 90° on either side of the snap fastener when engaged on the holster.

18. The scabbard of claim 15, wherein the holster and cover are fabricated from a single piece of flexible material.

19. The scabbard of claim 18, wherein the flexible material further comprises a fabric and foam laminate.

20. The scabbard of claim 18, wherein the flexible material further comprises a fabric and closed cell foam laminate that has been molded to form the curved front of the holster and flat back of the holster, and wherein the flexible fabric is folded and the front of the holster is sewn to the back of the holster.

21. The scabbard of claim 15, wherein the clip further comprises a mounting plate having a plurality of horizontal slots and an adjustable spacer insertable in each of the plurality of horizontal slots, wherein at least one of the slots is located such that when the adjustable spacer is inserted therein a position of the scabbard is raised relative to the equipment worn by the user.

* * * * *